US010307631B2

(12) United States Patent
Jeremic et al.

(10) Patent No.: US 10,307,631 B2
(45) Date of Patent: Jun. 4, 2019

(54) ELECTRONICALLY CONTROLLED MECHANICAL RESISTANCE DEVICE FOR ROWING MACHINES

(71) Applicants: Bojan R Jeremic, Natick, MA (US); Hrayr Nazarian, Lexington, MA (US)

(72) Inventors: Bojan R Jeremic, Natick, MA (US); Hrayr Nazarian, Lexington, MA (US)

(73) Assignee: Bojan Jeremic, Natick, MA (US)

( * ) Notice: Subject to any disclaimer, the term of this patent is extended or adjusted under 35 U.S.C. 154(b) by 140 days.

(21) Appl. No.: 15/694,041

(22) Filed: Sep. 1, 2017

(65) Prior Publication Data

US 2019/0070448 A1 Mar. 7, 2019

(51) Int. Cl.
*A63B 21/005* (2006.01)
*A63B 22/00* (2006.01)

(52) U.S. Cl.
CPC ..... *A63B 21/0058* (2013.01); *A63B 21/005* (2013.01); *A63B 21/0053* (2013.01); *A63B 21/0054* (2015.10); *A63B 21/0055* (2015.10); *A63B 21/0057* (2013.01); *A63B 21/0059* (2015.10); *A63B 22/0076* (2013.01); *A63B 2022/0079* (2013.01)

(58) Field of Classification Search
CPC ..... A63B 21/005; A63B 21/0051; A63B 21/0052; A63B 21/0053; A63B 21/0054; A63B 21/0055; A63B 21/0056; A63B 21/0057; A63B 21/0058; A63B 21/0059; A63B 22/0076; A63B 2022/0079; A63B 2022/0082; A63B 2022/0084
See application file for complete search history.

(56) References Cited

U.S. PATENT DOCUMENTS 3,589,193 A * 6/1971 Thornton ..... A61B 5/221 482/2
5,360,382 A * 11/1994 Chi ..... A63B 21/0058 482/1
5,919,115 A * 7/1999 Horowitz ..... A63B 21/00181 482/1
5,993,356 A * 11/1999 Houston ..... A63B 21/0058 482/4
7,671,550 B2 * 3/2010 Wang ..... A63B 21/0058 318/261
7,871,355 B2 * 1/2011 Yeh ..... A63B 21/00196 482/1
7,976,434 B2 * 7/2011 Radow ..... A63B 21/00196 482/5
10,220,261 B1 * 3/2019 Garsdean ..... A63B 24/0087
2012/0053014 A1 * 3/2012 Zhu ..... A63B 21/00069 482/5
2014/0371913 A1 * 12/2014 Zeltzer ..... G05B 15/00 700/275

(Continued)

*Primary Examiner* — Joshua Lee

(57) ABSTRACT

This invention offers a rowing machine's mechanical resistance device which comprises an electric motor or a solenoid, a programmable control means and a custom algorithm, controlling the programmable controls means. It eliminates the compromising effect of backlash between the rower's handle and the resistance imparting device. This backlash is present between the power and the idle phases of rowing strokes on all state of the art rowing machines comprising flywheels. Ultimately, this invention allows all rowers to improve their rowing form and avoid injury.

8 Claims, 10 Drawing Sheets

(56) References Cited

U.S. PATENT DOCUMENTS

| | | | | |
|---|---|---|---|---|
| 2018/0021616 | A1* | 1/2018 | Orady | A63B 21/0059 482/5 |
| 2018/0099178 | A1* | 4/2018 | Schaefer | A63B 24/0084 |

* cited by examiner

ELECTRONICALLY CONTROLLED MECHANICAL RESISTANCE DEVICE FOR ROWING MACHINES

FIELD OF THE INVENTION

The invention relates to the field of exercise equipment and more specifically to rowing machines.

BACKGROUND

Most state-of-the-art rowing machines allow oarsmen to simulate motions comparable to ones found when rowing in racing shells. To impart resistance to the rower's physical effort, some rowing machines deploy hydraulic rams (U.S. Pat. No. 5,104,363). However, the most successful ones, in terms of their ability to simulate rowing in boats, deploy an adjustable fluid pump. In certain embodiments, the pump moves air (U.S. Pat. No. 5,382,210) and in the other, the pump moves liquid water (U.S. Pat. No. 4,884,800). Regardless of the type of fluid, all said pumps comprise flywheels. The purpose of moving a fluid through a pump is to simulate an oar drag through water. The purpose of the integrated flywheel is to simulate a boat's inertia.

The beneficial effects of deploying flywheels on rowing machines relate to the flywheel absorbing the user's energy. Since the moment of inertia of a flywheel is constant, the added energy manifests as the flywheel's rotational motion. As this motion simulates that of a gliding boat, the torque resisting a rower suddenly changing the flywheel's rotational velocity is analogous to the force resisting a rower changing the speed of a moving boat.

The problem in using flywheels on rowing machines relates to how a rower applies his force to it. On other type of exercise devices, the combined user's motions tend to be synchronous to the moving flywheel. For example, peddling an exercise bicycle involves moving the feet in a circular motion, synchronous with its flywheel's rotation. In contrast, on a rowing machine, a rower engages the flywheel only during the power portion of the rowing strokes. Furthermore, at the beginning of the power phase of a stroke, the rower handle's velocity is zero, asynchronous to the already moving flywheel.

To engage the moving flywheel, a rower has to catch up to it at the beginning of the power phase of all but the first stroke during every practice. In addition, reconnecting with the moving flywheel becomes more difficult as the flywheel moves faster during more intensive exercise. In an effort to catch up to the flywheel, rowers tend to jerk their shoulders and forearms. The additional shoulder and forearm movement is not ideal and it is contrary to the proper rowing form. More importantly, rowing in such a way can also cause back injury.

In order to retain the flywheel's benefits and at the same time avoid its adverse effects, it is best to replace it with a more optimal device. To that end, this invention focuses on replacing not just the flywheel, but also the fluid pump comprising a flywheel. An embodiment of this invention comprises an electric motor/generator and the motor's control means. Alternatively, the motor can also be substituted with a linear acting solenoid.

Regardless of a given embodiment, the focus of this invention is to eliminate the need for rowers to catch up to the moving flywheel at the beginning of the power phase of every stroke. That is, the primary goal of this invention is to eliminate any backlash between the motion of the rower's handle and the motion of the resistance imparting device.

The additional benefit of deploying electric motors or solenoids is that in certain embodiments, this invention can also produce the handle pressure into the back of the rower's palms, at the beginning of the power phase of a rowing stroke. This pressure is similar to the pressure experienced by rowers when rowing in real boats and inserting the oar blade into the moving water.

SUMMARY OF THE INVENTION

The primary goal of this invention is to eliminate the backlash that exists when exercising on state of the art rowing machines. This backlash is present between the idle and the power phases of rowing strokes and occurs on any common rowing machine that comprises a flywheel. It is hoped that this invention is used to substitute the flywheel integrated with other mechanical resistance means with a device comprising an electric motor/generator or a solenoid and a programmable control means.

By eliminating the backlash occurring on commonly used rowing machines, this invention allows the rowers to execute stress free rowing strokes. Stress free rowing leads to achieving better rowing technique, which translates to faster moving boats. Most importantly, better rowing technique contributes to significantly reducing the potential for rowers to sustain motion related injuries.

This invention can also produce the handle pressure into the back of the rower's palms, in the beginning of the power phase of rowing strokes. This pressure is similar to the pressure that a rower feels by rowing in a boat, while inserting the oar blade into the moving water.

DETAILED DESCRIPTION OF THE PREFERRED EMBODIMENTS

Figure 1:
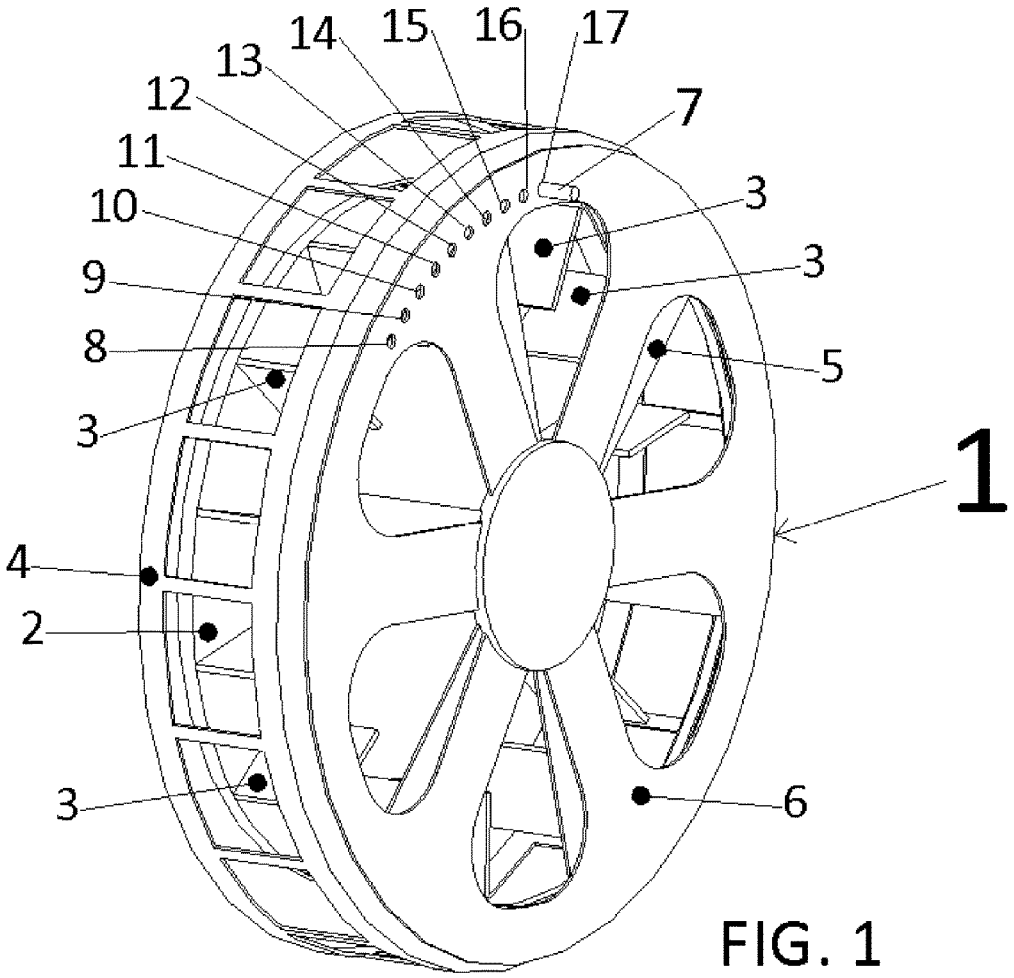
FIG. 1 shows an example of a prior art device.

This invention is intended to replace a common mechanical resistance device on rowing machines. An example of a prior art device is shown in FIG. 1, where system 1 is an air pump. The rotating parts comprise the flywheel 2 and a multitude of air peddling vanes 3, perpendicularly disposed and rigidly affixed to the flywheel's largest surface. The mechanism also includes a valve, comprising the stationary and the adjustable components. The stationary components of the valve are the safety shroud 4 and the face plate 5. Together, they envelop the rotating pump parts, forming a cavity in which the air peddling vanes 3 move the air as the flywheel rotates. The face plate 5 is perforated. It is disposed centered and parallel to the flywheel 2. It also shields the air peddling vanes 3 from accidental contact with objects outside of the pump. Since the valve cover 6 is also perforated, its rotation on top of the perforated faceplate 5 causes different interference openings between the two. A user rotates the valve cover 6 to adjust the system's pumped air throughput. The more air the system pumps, the higher is its resistance to the rotation and vice versa. To lock the valve cover, a user inserts pin 7 through one of the locator holes 8-17.

Figure 2:
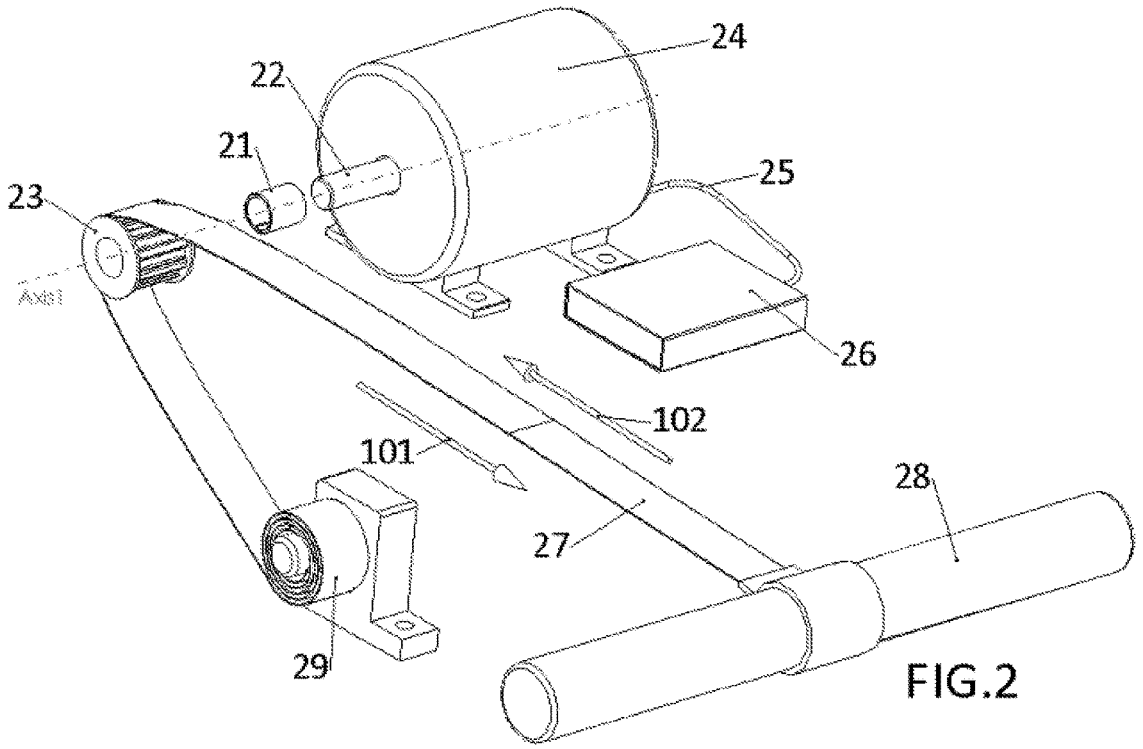
FIG. 2 shows a basic embodiment of this invention, depicted in three dimensions.

An embodiment of this invention is shown in FIG. 2. The inner diameter cylindrical surface of the one way clutch 21 couples to the motor's shaft 22 and the outer diameter surface rigidly couples to the bored hole of the timing pulley, or a sprocket, 23. Said one way clutch drivingly engages said pulley and the motor's shaft 22 only during the power phases of rowing strokes. The timing belt, or a chain, 27 drivingly couples to said timing pulley 23. One of the timing belt's ends attaches to the rower's handle 28 and the other attaches to the recoiling mechanism 29. The handle movement following the direction of vector 101 uncoils said timing belt 27. Its movement in the opposite direction, following vector 102, causes said timing belt, or a chain, 27 to recoil. Vector 101 coincides with the direction of the handle's motion during the power phase of rowing strokes and vector 102 coincides with the handle movement during the idle phase of rowing strokes. Said recoiling mechanism 29 and said motor 24 are rigidly affixed to the rowing machine and said motor/generator 24 also attaches via the wiring harness 25 to the motor control means 26.

The invention's general function is to provide a mechanical resistance countering the rower's physical effort. This resistance manifests as torque on said motor's shaft 22. The combination of said timing pulley 23 and said timing belt 27 convert the torque from the motor's shaft to the linear force, transmitted to the rower's handle. The force resists the linear and mainly horizontal motion of said handle 28, during the power phase of rowing strokes. During the idle phase, the recoiling mechanism 29 maintains the tension on said timing belt 27 and helps the rower move said handle 28 in the opposite direction.

In contrast to said legacy device (FIG. 1), where the torque resisting its rotation is dependent on the rotational velocity of its comprising flywheel 2, the new device (ND), shown in FIG. 2, is capable of producing a full range of torques at any rotational velocity of its comprising motor. By controllably managing the torque output of the motor's shaft, the ND can produce a custom set of torque responses corresponding to a set of rower handle's velocities.

To achieve instantaneous torque adjustment, the ND rapidly shorts and opens its motor winding's leads. Shorting and opening the motor windings effectively manages the motor's induced currents. In order to toggle similar currents several thousand times per second, said motor control means 26 must comprise at least one microcontroller or an equivalent. The microcontroller provides the control signal to the gate of at least one power transistor, which switches the current, or the combined currents generated by the motor windings. The microcontroller's control signal affecting the gate of said power transistor comprises on/off square pulse cycles, which in the art of electronic engineering is referred to as Pulse Width Modulation (PWM). In constructing a ND, the requirement is that a selected said power transistor must be capable of toggling currents and voltages comprising power comparable to the maximum power output of any rower. The same applies for a selected motor, which also must be capable of handling at least the maximum power output of a rower.

Depending on a given requirement, the ND implements torque adjustments from several times to a few hundred times per second. For example, while a rower's handle is at rest, there is no need to adjust the torque rapidly. However, when a rower is pulling said handle 28 (FIG. 2) during the power phase of rowing strokes, the torque needs adjustment at least one hundred times per second. In a typical scenario, the ND's microcontroller 51 (FIG. 3) signals the 'shorting' power transistor 39 to toggle the generated motor current at above audio range frequencies. Selecting above audio range frequencies relates to avoiding noise pollution caused by these frequencies resonating in said motor's cavity. A precise torque adjustment can be accomplished by instantly varying the pulse width ratio between the 'on' and the 'off' portions of the switching PWM cycles.

Figure 3:
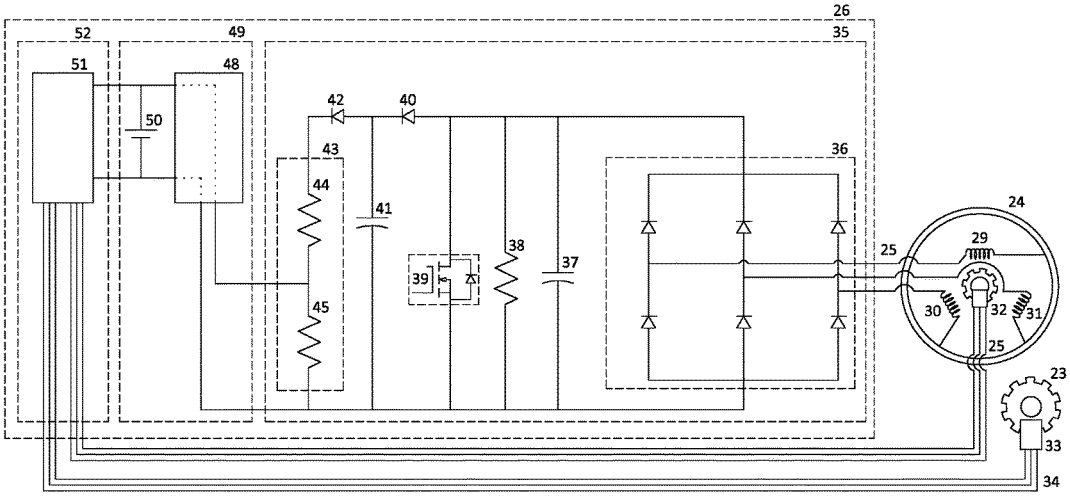
FIG. 3 shows a basic embodiment in a two dimensional schematic, while emphasizing the details related to this invention's electronic controller. As depicted, the controller is used to manage a BLDC motor and control the motor's torque, which resists the rower's physical effort.

An embodiment of a ND can comprise several motor types, most notable of which are the brushless DC (BLDC) and the brushed DC motor. In the embodiment of FIG. 3, said motor 24 is a multiphase BLDC. In addition to said 'shorting' power transistor 39, the power section of this embodiment's controller 35 also comprises a rectifying section 36, employing a multiphase diode H-bridge. This section combines and rectifies the generated AC currents from said motor/generator 24. The power section of said controller 35 further comprises filter 37, which smoothes the rectified and summed current. In turn, said 'shorting' power transistor 39, switched by the microcontroller 51, controllably toggles the smoothed current. Also, the power section 35 comprises the startup resistor 38. This resistor attaches in parallel to the 'shorting' power transistor 39 and it is responsible for providing resistance to the motion of said handle 28 while the controller 26 is inactive. The purpose of limiting this motion is to limit the induced voltage in said motor 24, thereby protecting the 'shorting' transistor 39 from over voltage damage.

The ND's controller also comprises a large capacitor 41 (FIG. 3), used to store the induced charge from the motor's windings. Said capacitor 41 connects in parallel to said 'shorting' power transistor 39. The ND harnesses the charge during the 'off' portions of said PWM cycles. As said 'shorting' transistor 39 disengages from shorting the motor's windings 29, 30, 31, the impedance across the charging capacitor becomes less dominant, compared to the infinite impedance of the open circuit set by the transistor 39. This allows the majority of the induced current to flow through the charging capacitor 41. As the 'shorting' transistor 39 shorts said motor's windings 29, 30, 31 (PWM on portion), the short circuit's impedance becomes the least dominant. This makes the majority of the induced current bypass the charging capacitor 41. The ND uses the stored charge to recharge its own battery pack 50, allowing it to be independent of an external charge supply. The battery pack 50 allows the controller to remain active during the sleep and the startup phases of operation. The excess energy can also charge an external power-consuming device.

To charge its battery pack, the ND also comprises the battery charging means 48 (FIG. 3). Through this apparatus, the battery pack 50 consumes the energy from said charge harnessing capacitor 41. The charging means 48 attaches to said charging capacitor 41 through the voltage divider 43. A detailed description of the charging means 48 is omitted as current state of the art inexpensive circuitry performing similar function is readily available.

Figure 4:
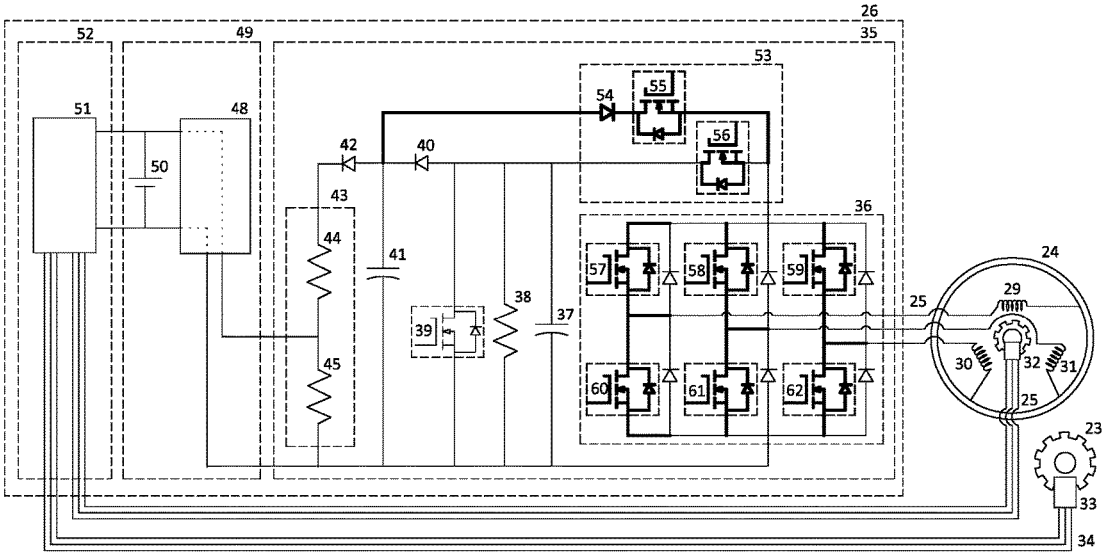
FIG. 4 shows a similar embodiment to that of FIG. 3. However, in addition to controlling the torque resisting the rower's physical effort, the controller is augmented to drivingly engage the attached BLDC motor.

In the embodiment of FIG. 4, motor 24 is once more a multiphase BLDC. However, the rectification section 36 also comprises multiple power transistors 57-62. Each transistor is disposed in parallel to each diode comprising the multiphase H-bridge 36. The transistors are attached so that the poles of their flyback diodes align with the poles of the diodes comprising the H-bridge. The additional power transistors 57-62 allow the controller to drivingly engage the motor's shaft. In order to move the motor, the ND's controller must commutate the forward driving current through said multiphase bridge 36. To commutate the current, the ND must obtain the position of the motor's windings 29, 30, 31 with respect to the motor's magnetic poles. Hence, in this embodiment, the ND also comprises sensor, or sensors, 32 that detect the absolute position of its motor's shaft. In order to draw charge from said charging capacitor 41 back into the motor, the embodiment of FIG. 4 also comprises the charge feedback circuit 53. This circuit further comprises the forward feedback transistor 55, the blocking transistor 56 and the diode 54. The forward feedback transistor 52 discharges the charging capacitor 41 into the rectifier 36, and the blocking transistor 53 decouples the fed back current from the charging capacitor 41. Said diode 54 ensures that the current in the feedback circuit 53 always flows in one direction, which is into the rectifier 36.

Figure 5:
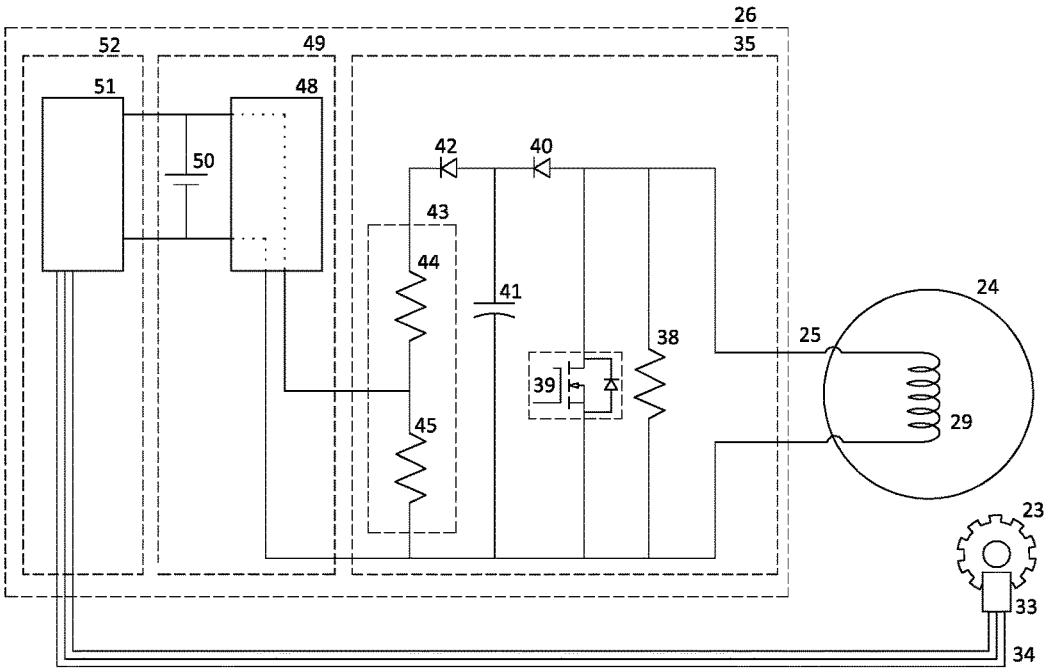
FIG. 5 shows a basic embodiment in a two dimensional schematic. As depicted, the controller manages a DC motor and controls the motor's torque resisting the rower's physical effort.

In the embodiment of FIG. 5, the combination of the microcontroller 51, or its equivalent, and the 'shorting' power transistor 39 toggle the induced currents coming from a brushed DC motor 24. Since the generated current is direct, there is no need to rectify or filter it. Therefore, unlike the embodiment of FIG. 3, the power section 35 of FIG. 5 comprises neither a rectifier nor a filter. Also, similar to the embodiment of FIG. 3, in this embodiment, the ND does not drivingly engage the motor 24.

In general, the ND controls the motor's torque based on instantaneous system requirements. The instantaneous adjustment of the motor's torque is only required during the drive portion of a stroke. Similar adjustment is not necessary during the recovery phase of a stroke. In order to detect whether a rower's handle is in the recovery or in the drive phase, the ND must also comprise sensors similar or equivalent to a rotary quadrature encoder 33 (FIG. 3) coupled to said timing pulley 23. Said encoder 33 attaches to said microcontroller 51 through the wiring harness 34. The underlying requirement of implementing this encoder, or similar, is that said microcontroller 51, within any given millisecond interval, must be aware of the change in position and the motion direction of the rower's handle 28 (FIG. 2). Since the handle is coupled to said pulley 23, detecting the change of position of said pulley 23 over a millisecond interval is sufficient.

The component that makes this invention unique is the algorithm managing its resistance imparting device. A major goal of this algorithm is to ensure that at the beginning of the power phase of a rowing stroke, the velocity of the rower's handle is not out of sync with the velocity of the resistance imparting device. Under optimal conditions, as the handle approaches the drive/power phase of a stroke, and before the rower's handle completely stops, the ND sets the motor shaft's rotational velocity to zero. In order to slow down the motor in due time, the ND detects the transition between the end of the drive and the beginning of the recovery phase of a stroke. To determine this information, it relies on said encoder 33 (FIG. 3). Immediately after the recovery phase begins, the ND attempts to lock the motor's shaft by putting emphasis on shorting the motor's windings 29, 30, 31 (FIG. 3) within said switching PWM (on/off) cycles. At the beginning of the power phase of a rowing stroke, slowing down the motor shaft's velocity to zero equalizes its speed to that of the rower's handle. The synchronization between the two provides a prerequisite for avoiding backlash between them. The ND almost completely avoids said backlash by also setting a relatively high level of torque on the motor's shaft during the synchronization. In a worst-case scenario, if there is insufficient time to stop the motor completely (before the handle velocity reaches zero), the ND minimizes the motor shaft's rotational velocity. Although some backlash may remain, slowing the motor down minimizes it. For the first instance of the power portion of a stroke, the ND holds a constant torque at a maximum useful torque level. As the handle 28 (FIG. 2) starts moving into the drive phase, the ND rapidly diminishes the torque level, but only for the first fraction of a stroke. Throughout the rest of the drive/power phase, the ND progressively varies the torque with the handle velocity.

In the embodiment of FIG. 4, the ND also uses the stored charge to drivingly engage the motor. As a rower exercises at higher stroke per minute rates, during a stroke's recovery phase, there may be instances when the rower moves the handle 28 (FIG. 2) faster than the velocity of the handle tensioned solely by said retracting mechanism 29. The velocity mismatch develops a slack in said timing belt 27 and can potentially uncouple it from the timing pulley 23. The ND's controller anticipates a similar condition by monitoring the handle's acceleration using said encoder 33 (FIG. 3). During similar instances, if there is sufficient charge in said charging capacitor 41, the ND drivingly engages the motor 24, providing additional tension to the timing belt 27 (FIG. 2). Alternatively, the ND may drivingly engage the motor 24 an instant after the handle slows down to zero. The engagement occurs subsequent to the beginning of the drive phase of a stroke. The purpose of this engagement is to create a positive tension between the handle 28 and the rower's shoulders. This tension is beneficial as it promotes rowing with proper posture.

Figure 6:
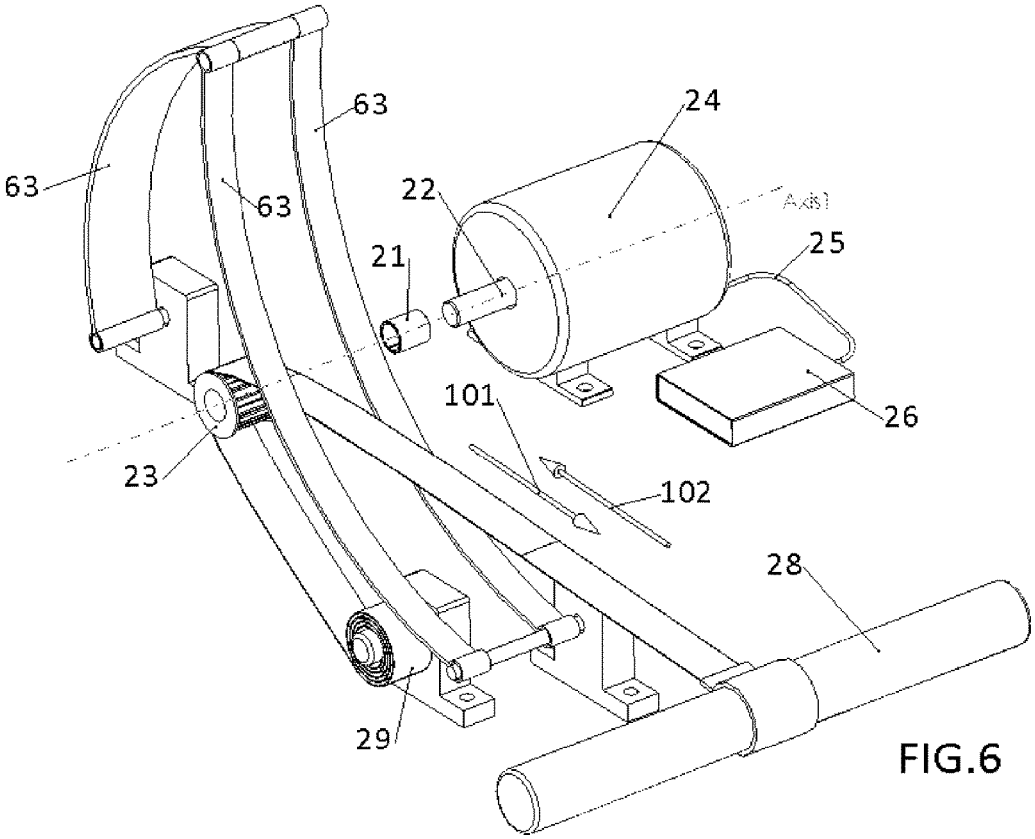
FIG. 6 shows an augmented FIG. 2 embodiment. The three dimensional drawing relates to the two dimensional schematic shown in FIG. 4. In addition to the basic functionality of providing the resistance to the rower's physical effort, the depicted embodiment comprises a spring that allows the device to push the handle into the back of the rower's palms, at the beginning of the power phase of rowing strokes.

In the embodiment of FIG. 6, the ND also comprises a compression spring 63 that the handle 28 engages at the last portion of the stroke's recovery phase. Said spring is also affixed to the rowing machine. In addition, this embodiment comprises said multiphase H-bridge arrangement of the power transistors 57-62 (FIG. 4), as well as said feedback circuit 53. As the handle 28 (FIG. 6) engages the spring 63, the ND's controller drivingly engages the motor 24, which in turn compresses the spring 63. Eventually, the controller halts the handle, locking the spring in a compressed position.

Immediately after, the ND's controller 51 (FIG. 4) releases the spring. To control the spring's rebound, the ND's controller partially engages the 'shorting' power transistor 39 and fully disengages said feedback circuit 53 and the rectifier disposed power transistors 57-62. The rebounding spring pushes the handle into the back of the rower's palms, which mimics the oar handle's motion produced by rowing in a shell, while inserting the oar blade into the moving water. As the handle 28 moves further toward the rest of the drive, the ND switches to the mode of progressively adjusting the motor's torque with the handle velocity. In order to detect the contact of the rower's handle 28 (FIG. 6) to the spring 63, a similar embodiment also comprises an accelerometer on the body of the rowing machine or on the rower's handle 28, and a microcontroller algorithm which can detect the signature of the spring motion as the handle engages said spring. Said algorithm comprises accelerometer signal's peak detection while the handle position is known to be in the vicinity of the front end of the stroke.

Figure 7:
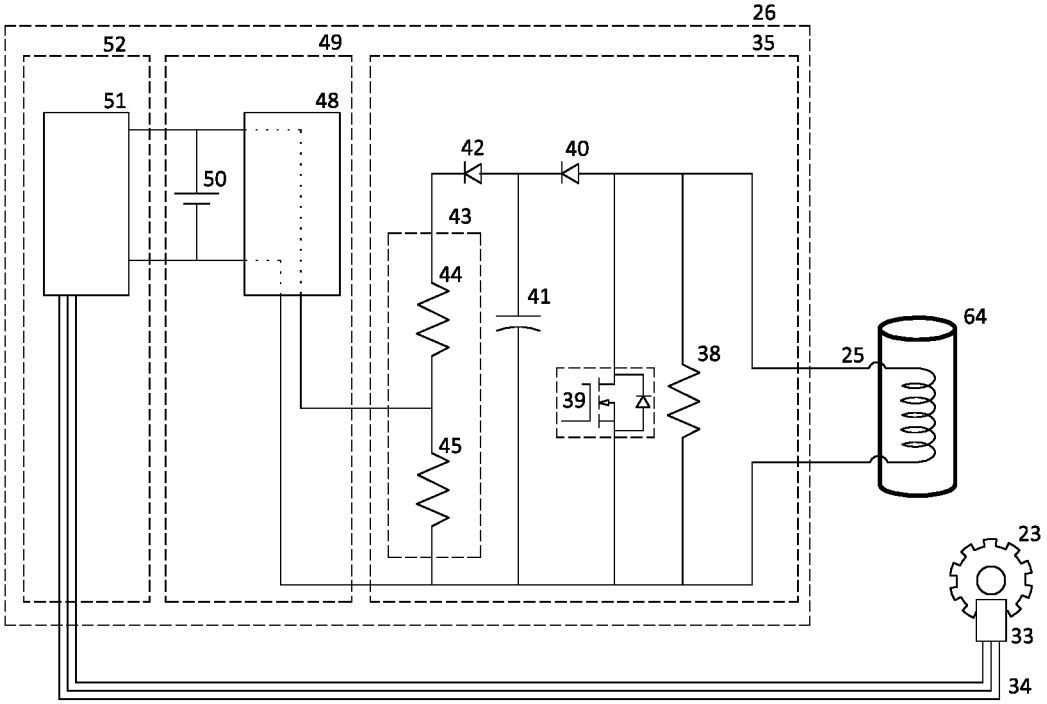
FIG. 7 shows an alternate embodiment in a two dimensional schematic. As depicted, the controller manages a solenoid and controls the solenoid's resistance to the rower's physical effort.
Figure 8:
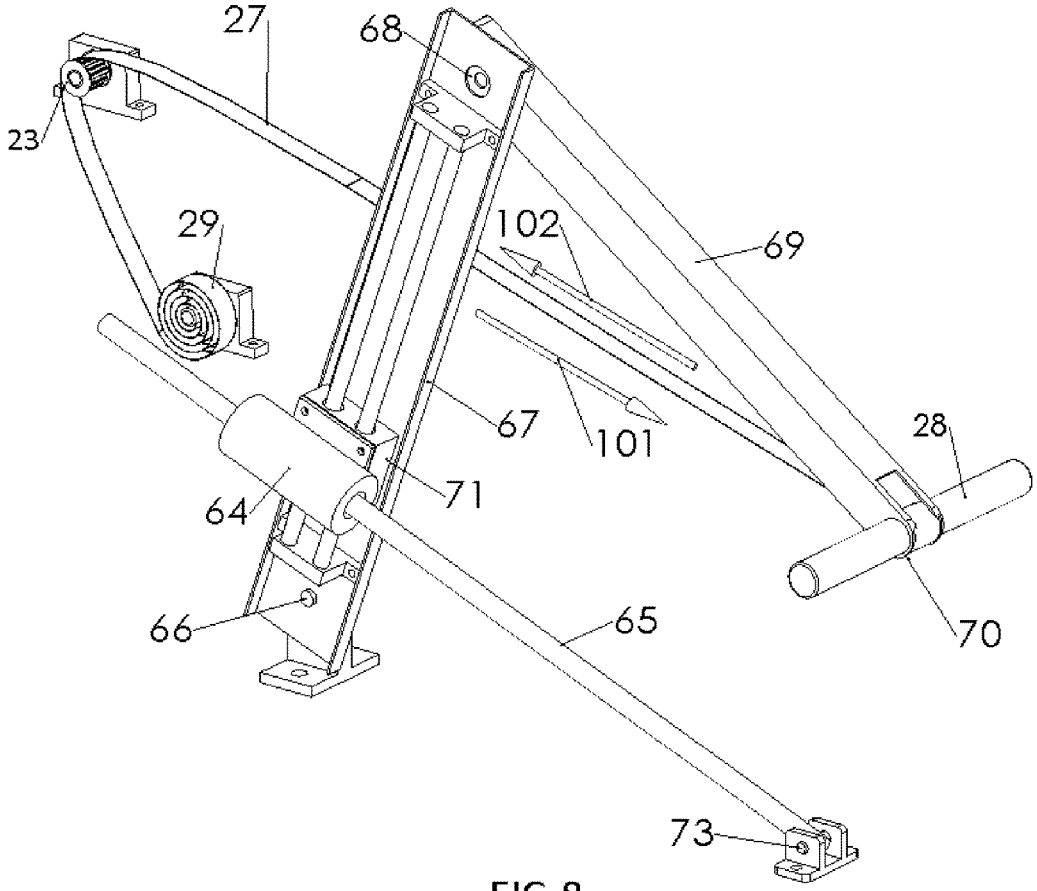
FIG. 8 depicts a three dimensional embodiment corresponding to the two dimensional schematic shown in FIG. 7.

In the embodiment of FIGS. 7 and 8, the combination of said BLDC motor and said one way clutch can also be replaced by the solenoid 64. As in the case of the embodiment of FIG. 5, the rectifier and the filter of the power controller's section 35 become superfluous. Said solenoid 64 (FIG. 8) drivingly engages the rower's handle 28 through the three joints 66, 68, 70, two piece scaffolding.

Figure 10:
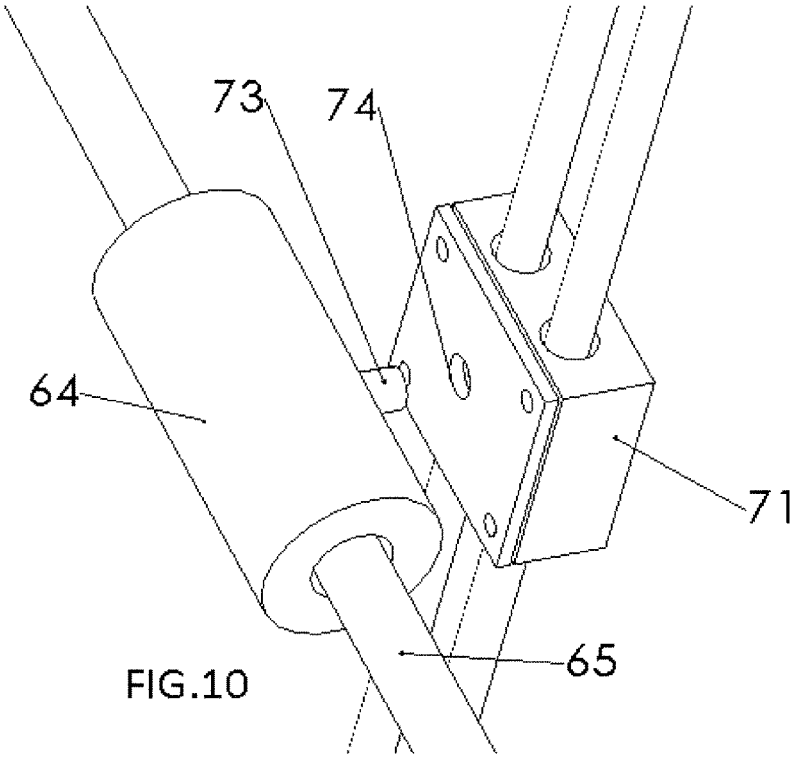
FIG. 10 shows a detail pertaining to the drawing shown in FIG. 9.

Said scaffolding comprises the bottom 67 and the top 69 rigid legs. The bottom scaffolding leg joint 66 is affixed to the rowing machine and it allows the bottom leg 67 to pivot around its bottom tip on a parallel plane constraining the motion of said timing belt 27. The middle scaffolding joint 68 couples the other tip of the bottom leg and the bottom of the upper scaffolding leg 69, and allows both legs to pivot with respect to one another on said plane, parallel to the plane constraining the motion of said timing belt 27. The top scaffolding joint 70 perpendicularly couples the rower's handle 28 to the top tip of the upper scaffolding leg 69, allowing the handle to rotate around its longest axes. Said solenoid 64 couples to the linear bearing block 71, wherein said linear bearing block slides longitudinally along said bottom scaffolding leg 67. Said solenoid 64 is tangentially disposed over said bearing block' largest surface, wherein said bearing block's surface is the one facing away from said bottom scaffolding leg 67. Said solenoid's housing has a cylindrical tab 73 (FIG. 10), which is perpendicularly affixed to the center of the largest cylindrical surface of the solenoid. This tab mates with the hole 74 in the center of said bearing block 71, wherein said hole is cylindrical and perpendicular to said bearing block's largest surface. The mated joint allows said solenoid to pivot around the center of said bearing block's largest surface. The solenoid's magnetic core rod 65 (FIG. 8) is affixed to the rowing machine through joint 73, allowing said solenoid to move longitudinally along said bottom scaffolding leg 67.

Figure 9:
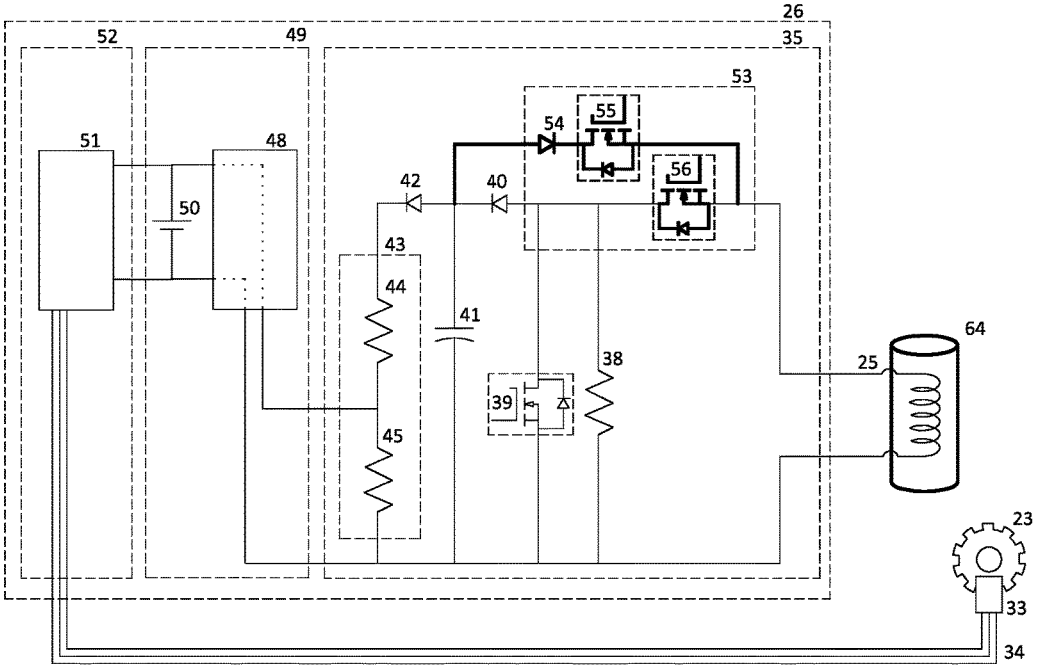
FIG. 9 shows an augmented FIG. 7 embodiment. In addition to the basic functionality of providing the resistance to the rower's effort, the depicted embodiment allows this invention to push the handle into the back of the rower's palms, at the beginning of the power phase of rowing strokes. Conceptually, this embodiment provides the same functional addition as the embodiment shown in FIG. 6.

As in the embodiments comprising said motor/generator 24 (FIG. 2), said solenoid provides resistance to the rower handle's motion. However, unlike the embodiments associated with rotating motors, this embodiment does not require any synchronization adjustments between the rower's handle and the resistance imparting mechanism. As shown in FIG. 9, the solenoid based embodiment can further be augmented with the controller that can drivingly engage said solenoid. As in the case of the embodiment of FIG. 4, the power section of the controller 35 shown in FIG. 9 comprises a charge feedback circuit 53. This circuit allows the charge stored in said charge storing capacitor 41 to be fed back to the resistance imparting mechanism, which in the case of the embodiment of FIGS. 8 and 9 is the solenoid 64. As in the case of the embodiment of FIG. 6, the ND causes the solenoid to move the handle at the beginning of the drive phase of a rowing stroke, causing the handle to push the back of the rower's palms. As stated, a similar pressure is experienced by rowers when rowing in real boats and inserting the blade into the moving water.

Finally, in any of the discussed embodiments, said motor/generator/solenoid control means 51 also comprises a means to connect it to an auxiliary computer 20. Said auxiliary computer obtains the data related to all discussed algorithms, and calculates the various workout display parameters from said data, such as rower's power consumption, traversed distance etc. Furthermore, the auxiliary computer can also input parameters back to the microprocessor 51.

The invention claimed is:

1. A device for a rowing machine which mainly provides mechanical resistance to simulated rowing comprising:

- a multiphase BLDC motor;
- a transmission means comprising a one way acting clutch, wherein:
  - an inner cylindrical surface of the clutch drivingly engages said motor's shaft;
  - an outer cylindrical surface of the clutch is press fitted into a timing pulley or a sprocket, wherein:
    - said pulley or said sprocket drivingly engages a rower's handle through a tensioned timing belt or a chain, attached to a middle of said rower handle's length;
  - said clutch drivingly engages said rower's handle to said motor's shaft during a drive phase of a stroke and decouples the two during an idle phase of a stroke;
- a motor control means mainly controlling said motor shaft's resistance to rotation and comprising:
  - a multiphase diode rectifier, used to rectify and sum said motor's induced currents into a common direct current;
  - a filter to smooth said rectified direct current;
  - a power transistor used to short and open the circuit comprising said rectified direct current;
  - a microcontroller controllably engaged to said transistor's gate, wherein:
    - a signaling technique from said microcontroller to said gate is pulse width modulation (PWM), wherein:
      - one PWM cycle switches the transistor's gate fully 'on' and then fully 'off';
      - wherein said PWM signal is configured to control a counter torque, resisting the rotation on said motor's shaft and therefore resisting the rower handle's motion during the drive phase of a stroke, wherein allowed torque settings range from:
        - the maximum, wherein said PWM fully 'on' portion of a cycle is at hundred percent and fully 'off' portion of a cycle is at zero percent; and
        - the minimum, wherein said PWM fully 'off' portion of a cycle is at one hundred percent and fully 'on' portion is at zero percent;
- a plurality of motion sensors attached to said microcontroller, wherein said sensors:
  - detect a position of said timing belt pulley or said sprocket, henceforth detecting a position and a motion direction of the rower's handle, also allowing said microcontroller to derive information regarding said handle's velocity and acceleration;

detect a position of said motor's shaft, also allowing said microcontroller to derive information about said motor shaft's velocity and acceleration;

a set of algorithms on said microcontroller comprising instructions that:

at the instance following a dead stop between an end of the drive phase and a beginning of the idle phase of a rowing stroke, attempt to stop said motor shaft's rotation, with the goal of completely stopping it before the beginning of the drive phase of the subsequent stroke wherein:

stopping of the motor's shaft causes it to synchronize its velocity to that of the rower's handle at the beginning of the drive phase of the subsequent stroke; and wherein said synchronization is configured to avoid backlash between the motions of the rower's handle and said motor's shaft;

set said motor shaft's torque relatively high at the beginning of the drive phase of a stroke for the purpose of avoiding said backlash;

throughout a first part of the drive phase of a rowing stroke, eases the torque on the motor's shaft as the velocity of the rower's handle suddenly increases from zero;

throughout the majority of the drive phase of a rowing stroke, increases the torque on the motor's shaft as the velocity of the rower's handle gradually increases;

a means to connect said microcontroller to another computer; and a means for collecting and storing electric charge induced in said motor's windings, comprising at least one capacitor wherein:

said charge collecting means connect in parallel to said power transistor's source and drain pins;

charge is mostly collected during said PWM 'off' cycle portions;

collected charge is used to:

power said motor control means; and potentially power or charge at least one more auxiliary power draining device.

2. The device according to claim 1, wherein said BLDC motor is replaceable with a brushed DC motor and said rectifier and said filter are configured to be removable from said motor control means.

3. The device according to claim 1, wherein a set of algorithms on said microcontroller comprise instructions that throughout the majority of the drive phase of a rowing stroke, adjust said motor's torque to follow a function proportional to the square of the velocity of the rower's handle.

4. The device according to claim 1, wherein said PWM modulation frequency is set above humanly audible frequencies, for the purpose of minimizing resonant amplification within said motor's enclosure, henceforth resulting in minimizing a perceived surrounding ambient audio pollution.

5. The device according to claim 1, wherein said motor control means can also drivingly engage said motor, wherein:

said motor control mean's rectifier also comprises transistors disposed in parallel to each rectifying diode, wherein Said transistors' flyback diodes poles are aligned with the corresponding diodes comprising said rectifier;

said charge collecting means also comprises a feedback circuit that discharges the collected charge back to said rectifier, wherein:

the collected charge is used to commutatively and drivingly engage said motor through said power transistors disposed within said rectifier;

wherein a commutation is derived from said sensors attached to said microcontroller and is configured the position of said motor's shaft; and said commutation is conducted by said microcontroller;

said motor can be drivingly engaged:

during the idle phase of a rowing stroke for the purpose of aiding the timing belt or the chain to maintain a recoiling tension on said timing belt or chain, as the rower's handle approaches the dead stop between the idle and the drive phases of a rowing stroke; and/or subsequent to the end of the idle phase of a rowing stroke for the purpose of extending the rower's arms and shoulders, wherein said extension can promote good rowing posture.

6. The device according to claim 5, wherein the device further comprises a compression spring disposed perpendicularly to the rower's handle, in vicinity of the end of the idle phase and the beginning of the drive phase of a rowing stroke, wherein:

said spring is compressed by the moving rowing handle as it approaches the end of the idle phase of a rowing stroke;

a contact between the rower's handle and the spring is detected by an accelerometer affixed to a body of the rowing machine or the rower's handle;

said drivingly engaged motor aids the compression of said spring;

said microcontroller also controls said spring's rebound;

wherein releasing said spring into the rower's handle applies pressure on the back of the rower's palms, such that the rower experiences similar pressure when rowing in a real boat.

7. The device according to claim 2, wherein said DC motor is removable and functionally replaceable by a solenoid, wherein:

said auxiliary solenoid is engaged to the rower's handle through a three joint, two leg scaffolding wherein:

the scaffolding comprises bottom and top rigid legs;

a bottom scaffolding leg joint is affixed to the rowing machine and allows the bottom leg to pivot around its bottom tip, parallel to the plane constraining the motion of said chain or said timing belt;

a middle scaffolding joint couples another tip of the bottom leg and the bottom of the upper leg, and allows both legs to pivot with respect to one another, on the same plane, parallel to the plane constraining the motion of said chain or said timing belt;

a top scaffolding joint perpendicularly couples the rower's handle to a top tip of the upper leg, allowing the handle to rotate;

said solenoid couples to a linear bearing block, wherein:

said linear bearing block slides longitudinally along said bottom leg;

a solenoid cylindrical housing is tangentially disposed to a bearing block surface facing away from said bottom leg;

a cylindrical tab is perpendicularly affixed to the center of the bearing block and mates with a hole in the center of said bearing block, wherein:

said hole in said bearing block is perpendicular to said bearing block surface;

said cylindrical tab allows said solenoid to pivot around the center of said bearing block's surface;

a magnetic core rod is affixed with one end to the rowing machine through a joint, allowing it to rotate on a plane parallel to said plane constraining the motion of said chain or said timing belt.

8. The device according to claim 7, also comprising a control means that can drivingly engage said solenoid, wherein:

a charge collecting capacitor supplies a charge;

the solenoid moves the bottom leg at the beginning of the drive phase of a rowing stroke, causing the handle to apply pressure to the back of the rower's palms, wherein a rower experiences similar pressure as when rowing in a real boat.

* * * * *